US007433271B2

(12) United States Patent
Kuepfer et al.

(10) Patent No.: US 7,433,271 B2
(45) Date of Patent: Oct. 7, 2008

(54) CALENDAR MECHANISM FOR DISPLAYING THE DATE AND THE DAY OF THE WEEK IN ONE TIMEPIECE

(75) Inventors: Marc Kuepfer, Riedholz (CH); Marco Bettelini, Prêles (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 321 days.

(21) Appl. No.: 10/541,542

(22) PCT Filed: Dec. 18, 2003

(86) PCT No.: PCT/EP03/51044

§ 371 (c)(1),
(2), (4) Date: Jul. 6, 2005

(87) PCT Pub. No.: WO2004/066039

PCT Pub. Date: Aug. 5, 2004

(65) Prior Publication Data

US 2006/0221773 A1 Oct. 5, 2006

(30) Foreign Application Priority Data

Jan. 7, 2003 (EP) ..... 03075060

(51) Int. Cl.
*G04B 19/20* (2006.01)

(52) U.S. Cl. ..... 368/28

(58) Field of Classification Search ..... 368/37, 368/38; 968/177–182; 74/665 F, 665 G, 74/665 S See application file for complete search history.

(56) References Cited

U.S. PATENT DOCUMENTS

| | | | | |
|---|---|---|---|---|
| 2,757,507 | A * | 8/1956 | Boyles | 368/37 |
| 3,777,582 | A * | 12/1973 | Durdin | 74/665 S |
| 3,969,888 | A * | 7/1976 | Veuilleumier et al. | 368/35 |
| 4,059,953 | A | 11/1977 | Morrison et al. | |
| 4,473,301 | A * | 9/1984 | Namyslo | 368/37 |

FOREIGN PATENT DOCUMENTS

CH 684 980 2/1995

OTHER PUBLICATIONS

International Search Report issued in corresponding application PCT/EP/51044 completed Jul. 13, 2004 and mailed Jul. 20, 2004.

* cited by examiner

*Primary Examiner*—Renee S Luebke
(74) *Attorney, Agent, or Firm*—Griffin & Szipl, PC

(57) ABSTRACT

The invention is a timepiece calendar mechanism for displaying the date and the day of the week, including a date indicator in the form of an internally toothed crown. The date indicator is driven by a first drive wheel having an external toothing so as to be able to be driven about an axis of rotation by a wheel set secured to an hour wheel of the timepiece. The toothing includes a prominent tooth, longer than the others, which abuts against a tooth of the inner toothing of the date indicator to move it forward one day in a time interval located around a determined time of the day. The mechanism also includes a day of the week indicator that moves forward one day during the time interval.

6 Claims, 5 Drawing Sheets

CALENDAR MECHANISM FOR DISPLAYING THE DATE AND THE DAY OF THE WEEK IN ONE TIMEPIECE

This is a National Phase Application in the United States of International Patent Application No. PCT/EP03/51044, filed Dec. 18, 2003, which claims priority on European Patent Application No. 03075060.8, filed Jan. 7, 2003. The entire disclosures of the above patent applications are hereby incorporated by reference.

FIELD OF THE INVENTION

The present invention concerns a calendar mechanism for displaying the date and the day of the week in a timepiece, including a date indicator in the form of an internally toothed crown, means for driving said indicator including a first drive wheel having an external toothing so as to be able to be driven about a rotational axis by a wheel set secured to an hour wheel of the timepiece and said toothing including a prominent tooth, longer than the others, which abuts against a tooth of the inner toothing of the date indicator to make it move forward one day in a time interval at around a determined time of the day, this mechanism also including a day of the week indicator, means for driving said day of the week indicator to make it move forward one day during said time interval and means for positioning said indicators.

BACKGROUND OF THE INVENTION

A mechanism of this type, similar to that which forms part of certain watch movements that are already manufactured and marketed by the Applicant is shown in an exploded perspective view in FIG. 1, as well as other elements of the movement which are directly related to this mechanism.

Among these elements there is an hour wheel 2 mounted at the centre of the movement and making one revolution in 12 hours, the pipe 4 of which is for carrying an hour hand that is not shown.

A pipe 6 of a minute wheel, itself surrounding an axis 8 of a second wheel, can rotate inside this pipe 4, said pipe 6 and said axis 8 being provided for respectively carrying a minute hand and a second hand which are also not shown.

On pipe 4 of hour wheel 2 and in contact with said wheel there is fixed a pinion 10 with six teeth 12, which meshes with a drive wheel 16. In order to make one revolution in 24 hours, this drive wheel, which pivots about a fixed arbour 14 of the movement and which includes twelve teeth 18, is solely responsible for driving both a day of the week disc 20 secured to a day star-wheel 22 and a date crown 24, in a manner that will be explained hereinafter.

Among the elements of the movement directly related to the date mechanism there is also a plate 26 that is partially shown, which includes an upper edge 28 that acts as a support for a dial 30 provided with an aperture 32. This plate 26 which allows dial 30 to be axially positioned, is also used for positioning it angularly by means that are not shown, such that its aperture 32 is located at 3 o'clock to allow the user of the watch containing the movement to read the day of the week and the date of the day correctly through the aperture.

Moreover, plate 26 also acts as a support for date crown 24, which is surrounded and held in place radially by edge 28 of the plate.

As the drawing shows, the day disc 20 which carries abbreviations of the seven days of the week twice in the same language and the day star-wheel 22 which consequently includes fourteen teeth 34, are mounted so as to be able to pivot about pipe 4 of hour wheel 2 and held in place axially by a key 36, the assembly of disc 20 and star-wheel 22 being able to be achieved for example by riveting or laser welding.

As regards date crown 24, which can be obtained by cutting and folding a sheet metal or a thin metal strip, it has a stair shaped profile and includes three concentric annular parts 38, 40 and 42, whose level decreases from the outside inwards.

The first annular part 38, whose contour corresponds to that of the crown, carries numbers from 1 to 31 regularly distributed over its surface. The second part 40, which receives day disc 20, has a slightly larger diameter than that of the disc so as not to disturb its rotation and the difference in level between this second part and the first is such that the day of the week and the date appear substantially in the same plane and close to each other in aperture 32 of dial 30. Third part 42 has an inner toothing which includes 31 radial teeth of isosceles shape 44 which correspond to the 31 days of the longest months.

The calendar mechanism of the movement of FIG. 1 also includes a holding plate 46 inserted between day disc 20 and third part 42 of date crown 24, which is fixed by means of screws 48 to a fixed part of the movement. This plate 46 has three functions. The first and second consist in holding drive wheel 16 and date crown 24 axially without disturbing their mobility. The third function is to act as jumper-springs for date crown 24 and for day star-wheel 20. In order to do this, plate 46 is cut and bent so as to form a first elastic tongue 50, which extends below the plane of the main part of the plate and which ends in a V-shaped end, pointed towards the exterior of the movement to be engaged between teeth 44 of date crown 24 and a second elastic tongue 52 extending above the plane of said plate 46 and which also ends in an end part that is V-shaped, but pointed towards the inside of the movement to be engaged between teeth 34 of day star-wheel 22, which are both radial and isosceles shaped.

In order to describe drive wheel 16 and the operation of the calendar mechanism of FIG. 1 in detail, reference will also be made to FIG. 2, which shows wheel 16 in perspective again but on a larger scale.

This wheel 16 includes a hub 54 via which it is mounted on arbour 14 and which is connected by a spoke-shaped connecting element 56 to a crown 58 which carries the aforementioned teeth 18.

Among these teeth 18 there is a prominent tooth 18' which extends radially beyond the others so as to be the only one able to be engaged between teeth 44 of date crown 24 while being able to be engaged like the others between teeth 12 of pinion 10. For a reason that will be understood hereinafter, this tooth 18' has a flank called the "front flank" 60 of the same inclination as the flanks of the other teeth, i.e. substantially radial, and a "back flank" 62 which, at the end of the tooth intended to be engaged between teeth 44 of crown 58 has an oblique face 64 of smaller inclination to form an acute angle with front flank 60.

This having been said, wheel 16 also includes an elastic arm 66 more or less shaped in the arc of a circle, integral with the other elements of wheel 16, attached to hub 54 and extending inside toothed crown 58. This arm has, at its free end, a first tongue of substantially rectangular shape and bent at 90° towards the front of the movement so as to form a drive finger 68 able to be engaged between teeth 34 of day star-wheel 22. Moreover, arm 66 and the orientation of drive finger 68 with respect to the flanks of teeth 34 are provided such that the arm is only deformed significantly when it is forced to move away from hub 54 of wheel 16 and very slightly in the opposite direction.

Finally, wheel 16 also includes a second tongue 70 of substantially rectangular shape, made in one piece with elastic arm 66, located in the plane of the wheel, at a certain distance from the end of the arm and extending in the direction of crown 58. The usefulness and advantage of this second tongue which is not involved in the operation of the calendar mechanism of FIGS. 1 and 2, will be specified hereinafter.

The calendar mechanism of FIGS. 1 and 2 is of the dragging type, i.e. the movement of the date forward one unit and passage from one day of the week to the next occur over a period of approximately four hours around midnight.

While the movement is operating normally, outside this time period, its motor, whether it is of the purely mechanical or electromechanical type, drives pinion 10 in the clockwise direction and calendar drive wheel 16 in the anti-clockwise direction indicated by arrow F1 in the drawing. During this time period, wheel 16 does neither mesh with date crown 24 nor with day star-wheel 22 whose positions are determined and maintained by jumper-springs 50 and 52 such that the indications of the date and day of the week appear properly framed in the aperture of dial 30 and without any shocks that the movement undergoes being able to alter said indications.

For a reason that will be explained hereinafter, drive wheel 16 is designed such that there is a certain phase shift, for example of approximately half an hour, between the start of driving day disc 20 and that of date crown 24 or conversely. Hereinafter, it will be assumed that we are in the first of these situations to describe the operation of the calendar mechanism of FIGS. 1 and 2 and a variant thereof that is also known and that of the mechanism according to the invention.

In these circumstances, when drive finger 68 comes into contact with the back flank of a tooth 34 of day star-wheel 22, the finger starts to exert a torque on said tooth 34, which is opposed by the action of jumper-spring 52. Gradually as drive wheel 16 rotates in the direction of arrow F1, elastic arm 66 becomes taut moving away from hub 54 and finger 68 slides along the flank of tooth 34 with which it is in contact and rotates star-wheel 22 and day disc 20 in the direction of arrow F2. At the same time, the end of jumper-spring 52 comes out of the hollow between two teeth of star-wheel 22 in which it was located, while the torque exerted by finger 68 on tooth 34 increases.

Approximately half an hour after the star-wheel and the day disc start to be driven, front flank 60 of tooth 18' of wheel 16 comes into contact with the back flank of a tooth 44 of date crown 24 and then starts to slide over this back flank and to rotate the date crown in the direction of arrow F3, i.e. in the same direction as drive wheel 16 and in the opposite direction to that in which day disc 20 is rotating. During this time, the end of jumper-spring 50 starts to come out of the hollow between two teeth 18 of the date crown in which it was located, said spring starts to tighten and the torque exerted by tooth 18' on tooth 44 with which it is in contact starts to increase.

During the period that follows, which is the longest of the time interval necessary to change the day and the date, wheel 16 simultaneously drives day star-wheel 22 and date crown 24 supplying a higher torque than that of the sum of the resistant torques exerted by jumper-springs 50 and 52 respectively on tooth 34 of day star-wheel 22 and that 44 of date crown 24 with which tooth 18' and tooth 34 of day star-wheel 22, these torques continuing to increase until the end of jumper-spring 52 reaches the tip of tooth 34 of day star-wheel 22.

In a very short instant, spring 52 is let down when its tip descends into the hollow of day star-wheel 22 following that between the teeth of which it was previously located, in the direction of arrow F2. At the same moment, drive finger 68 of arm 16 is ejected from the toothing of day star-wheel 22 while it was exerting a maximum torque on the latter and the day of the week indicated by disc 20 finishes passing to the next day.

A little later, the same process occurs for jumper-spring 50, the hollow between teeth 44 of date crown 24 between which its end was located and long tooth 18' of drive wheel 16, which means that the date indication moves forward one unit.

Thus, owing to the phase shift between driving the day disc and that of the date crown, the total torque provided by the drive wheel 16 never reaches the sum of the maximum torques exerted by said wheel on the day star-wheel and the date crown, which prevents the movement drive motor locking or at lest the disc and/or the crown moving backwards.

When an alteration of the date indication in particular during passage from a month of thirty days or less in the case of February to the next month, or an alteration both of the date and the day of the week indication, for example when the battery is changed in the case of an electromechanical movement or an extended lack of winding in the case of a mechanical watch, this or these changes can occur manually and quickly by means of a control stem and a correction mechanism that are not shown in the drawing. In the case of movements marketed by the Applicant, as in many others, the control stem is a stem which can be placed in three axial positions, a neutral or winding pushed-in position, a first pulled out position in which the date display can be altered by rotating the stem in one direction and the day of the week display by rotating the stem in the other direction and a second pulled out position reserved for setting the time of the hands of the watch.

When the date is set outside the time interval when neither the day disc nor the date crown are being driven by wheel 16, this does not cause any problems. However, very often, setting the day and more frequently setting the date occurs around midnight, i.e. during this interval.

When an alteration of the date occurs in these circumstances, the date correction mechanism non shown acts on teeth 44 of date crown 24 so as to rotate the latter in the direction of arrow F3, against jumper-spring 50 and each time that the front flank of a tooth 44 comes into contact with the oblique face 64 of the back flank of tooth 18' of drive wheel 16, this front flank of a tooth 44 slides over this oblique face of tooth 18' without substantially altering the angular position of tooth 18', owing to the natural elasticity drive wheel 16 which is then very slightly deformed and against the resistant torque then exerted on said wheel 16 by pinion 10, which rotates in the opposite direction at a much lower speed, which can even be considered to be zero.

In the case where, more rarely, the position of the day disc also has to be altered during the time interval in question, the correction mechanism drives day star-wheel 22 in the direction of arrow F2 making the end of jumper-spring 52 jump from a hollow between two teeth 34 to the next one. When a front flank of a tooth of day star-wheel 22 comes into contact with drive finger 68, it forces elastic arm 66 to curve very slightly in the direction of hub 54 of wheel 16 to return then to its initial position after finger 68 has passed to the tip of tooth 22.

Moreover, if the time is altered forwards, everything occurs in the same way as when the mechanism is operating normally, except that if this alteration occurs while the day and date change process is in progress, this process is accelerated during the period in which the time is being altered. However, if the time change occurs backwards, wheel 16 rotates in the opposite direction to that of arrow F1. In this case, when oblique face 64 is or comes into contact with a tooth 44 of the date crown, this tooth slides or continues to slide over this face, which causes or maintains a slight deformation of the crown of wheel 16 which means that the position of the wheel remains unchanged. When, during the same period, the back face of tooth 68 comes into contact with a tooth 34 of day star-wheel 22, this tooth slides over the back face which only causes a very slight deformation of arm 66 in the direction bringing it back to hub 54 of the wheel until tooth 68 reaches the tip of tooth 34. At that moment, the arm returns to its initial position without the position of star-wheel 22 and day disc 20 having been altered.

FIGS. 3 and 4 illustrate a variant of the calendar mechanism shown in FIGS. 1 and 2, which corresponds to a mechanism used in other movements, also manufactured and marketed by the Applicant.

As shown in FIG. 3, which is a top view of the day of the week disc and the day star-wheel, this star-wheel still being designated by the reference numeral 22 remains unchanged and still includes fourteen teeth 34.

However, day disc 20' no longer carries abbreviations of the successive days of the week twice in the same language, like disc 20 of FIG. 1, but alternatively, the abbreviations of the days in two languages, in this particular case, in English and French.

Consequently, in order always to have the day displayed in the same language, the day star-wheel and disc must no longer rotate normally by one fourteenth of a revolution per day, but by a seventh. In order to do this, the second tongue 70 of drive wheel 16 shown in FIGS. 1 and 2 simply has to be bent to make a second drive finger 70', as shown in FIG. 4. Thus, after first finger 68 has acted on a tooth 34 of day star-wheel 22 to rotate day disc 20' by a fourteenth of a revolution, second drive finger 70' acts in the same way on the following tooth 34 to rotate the disc again by a fourteenth of a revolution in the same direction.

As for first finger 68 and for the same reason, the action of second finger 70' is synchronised with that of tooth 18' so that the total torque that drive wheel 16 has to exert at the same time on day star-wheel 22 and date crown 24 never reaches the sum of the maximum torques necessary to rotate the star-wheel and the crown.

Moreover, when the day of the week is changed manually, second finger 70' acts like first finger 68, i.e. it forces elastic arm 66 to curve to allow star-wheel 22 and day disc 20' to pass to the display of a same day in one language to another, or from one day to the next in the same language.

Naturally, everything that has previously been said with respect to first drive finger 68 and arm 66 is also valid for second drive finger 70'.

Furthermore, this variant of FIGS. 3 and 4 justifies the presence of tongue 70 in the embodiment of FIGS. 1 and 2. In fact, in order to make drive wheels 16 that can be used in both cases, one need only cut flat parts having the two tongues for forming the two drive fingers 68 and 70' from a metal strip or plate, and bend only one of the tongues or both to obtain wheels which can be used either in the embodiment of FIGS. 1 and 2, or in its variant, which evidently constitutes a saving.

Despite this, this embodiment of FIGS. 1 and 2 and its variant have certain drawbacks.

First, wheel 16 made in a single piece of the same material does not allow optimum driving of both the day star-wheel and the date crown to be obtained as a function of the materials of which they may be formed, for example when the date crown is made of a copper and beryllium alloy whereas the day star-wheel is made of steel to allow a day disc to be laser welded onto said star-wheel.

Secondly, for a given movement, the phase shift sign and value between the driving of the day disc and that of the date crown are determined when drive wheel 16 is designed and manufactured. For various reasons, it may be preferable to start by driving the date crown rather than the star-wheel and the day disc and not necessarily with the same forward movement. In the case of the known mechanisms of FIGS. 1 to 4, this can only be achieved by replacing wheel 16 with another wheel.

Finally, thirdly, in these known mechanisms of FIGS. 1 to 4, drive wheel 16, which is actually very thin, has to drive both the date crown and the day star-wheel for a long time in opposite directions, which means that it is then subjected to quite significant stress which can greatly limit is life time and the proper operation or even just the operation of the calendar mechanism of which it forms a part.

SUMMARY OF THE INVENTION

It is an object of the invention to provide a calendar mechanism capable of indicating both the date and the day of the week, which does not have these drawbacks.

This object is attained owing to the fact that the mechanism according to the invention, which answers the definition given in the first paragraph hereinbefore, is characterised in that the day of the week indicator drive means include a second drive wheel provided with an external toothing, superposed with and coaxial to the first drive wheel and in that said first and second drive wheels have the same diameter and the same even number of teeth and are driven by the same wheel set secured to the hour wheel.

Preferably, said drive wheel is formed by a pinion fixed onto a pipe of said hour wheel and including a number of teeth equal to half that of said first and second drive wheels.

BRIEF DESCRIPTION OF THE DRAWINGS

Other features and advantages of this mechanism will appear upon reading the following description of two possible embodiments, a description that refers to the annexed drawings, among which.

DETAILED DESCRIPTION OF THE ILLUSTRATIVE EMBODIMENTS

Figure 1:
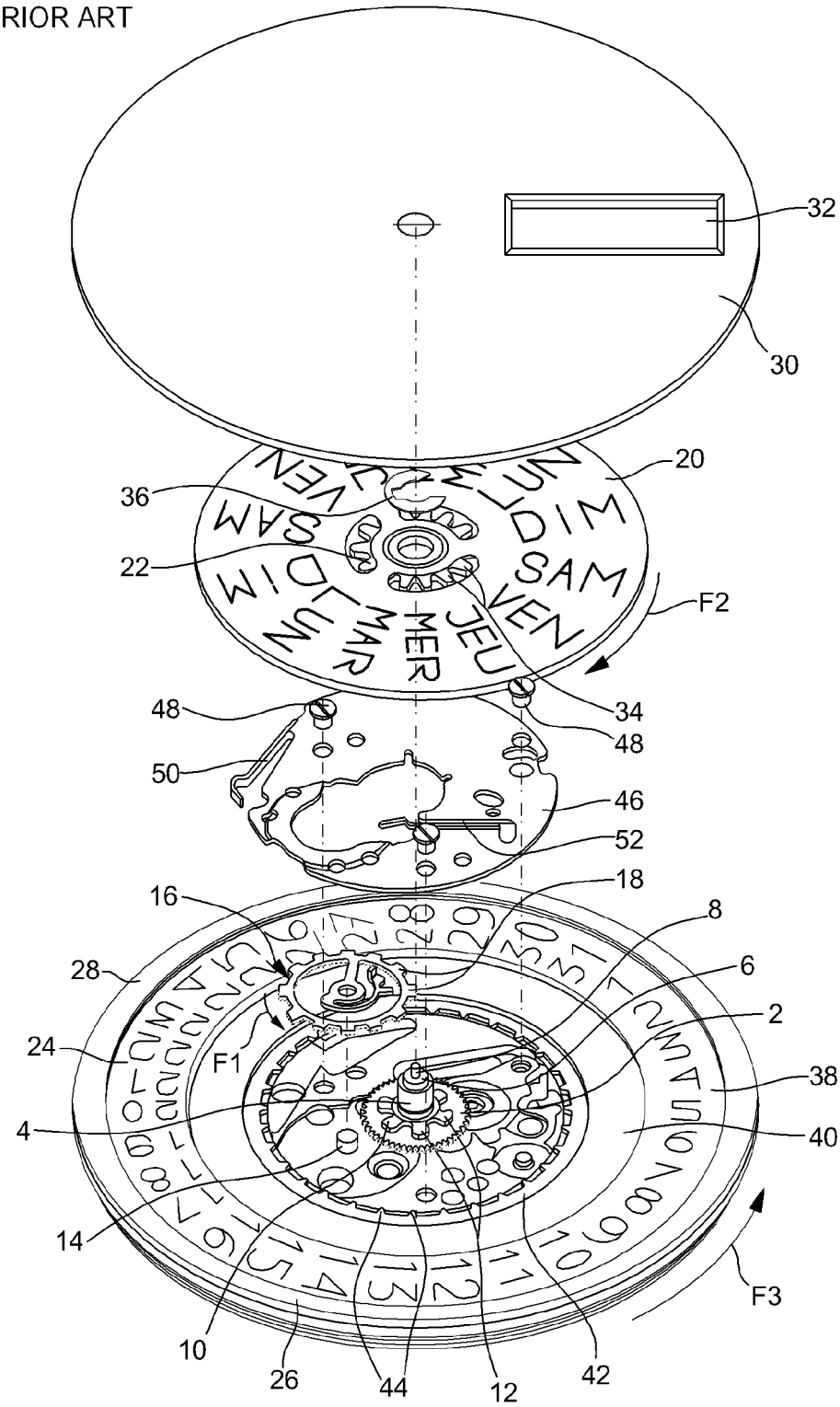
Fig.1 PRIOR ART
FIGS. 1 to 4, already defined hereinbefore, illustrate the state of the art, which, to the Applicant's knowledge, is the closest to the invention.
Figure 3:
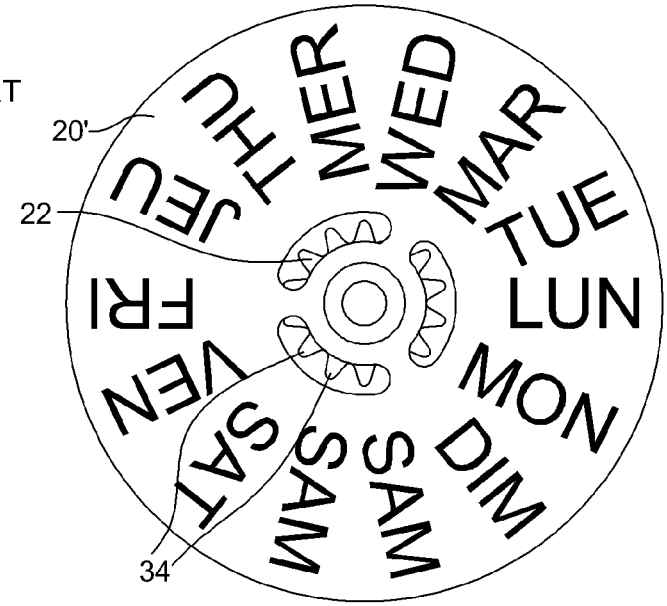
Fig.3 PRIOR ART
Figure 4:
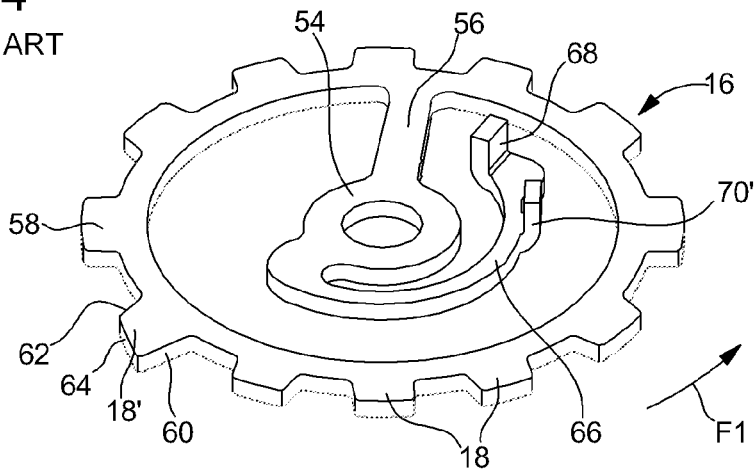
Fig.4 PRIOR ART
Figure 5:
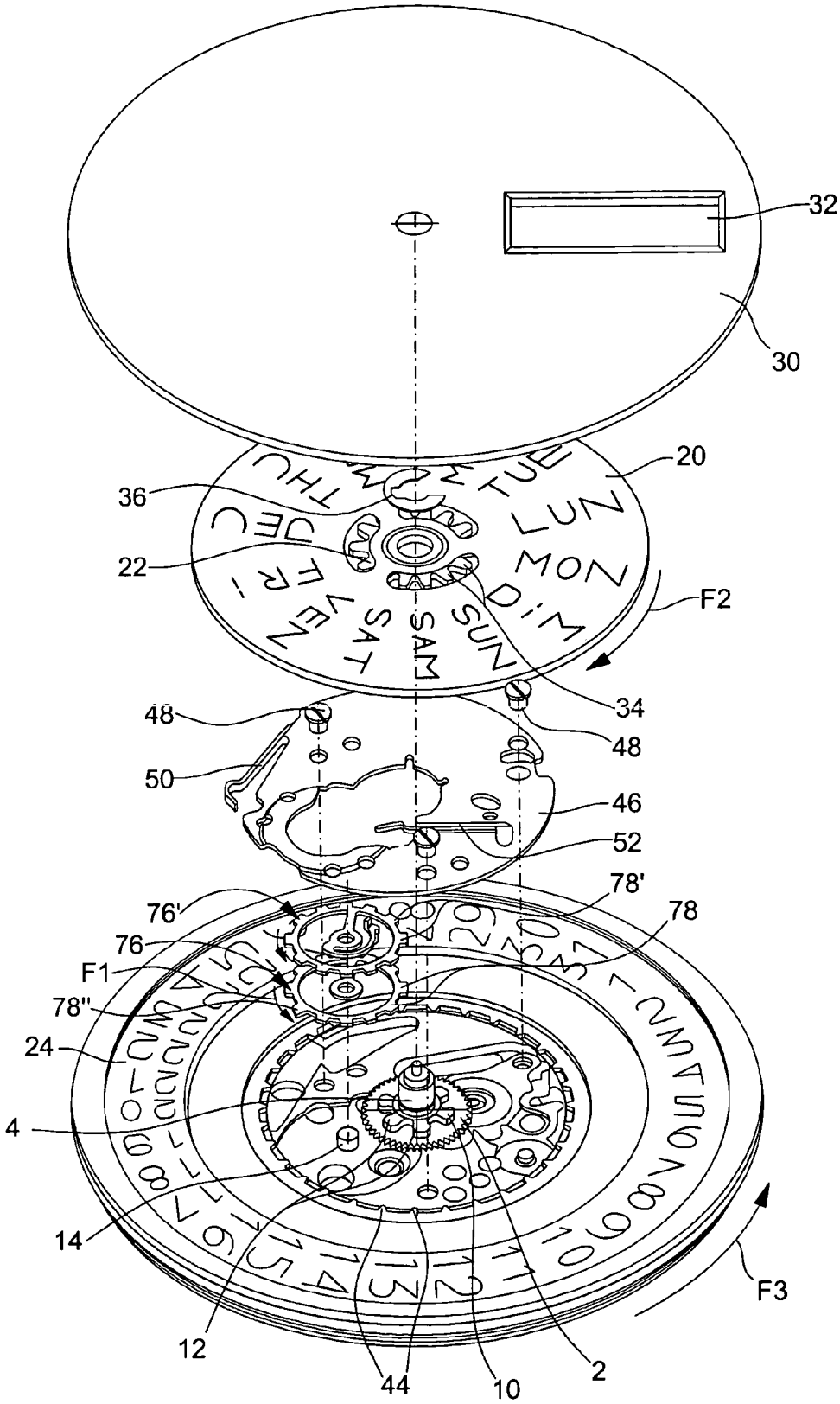
FIG. 5 is an exploded perspective view of a first possible embodiment of a mechanism according to the invention.
Figure 6:
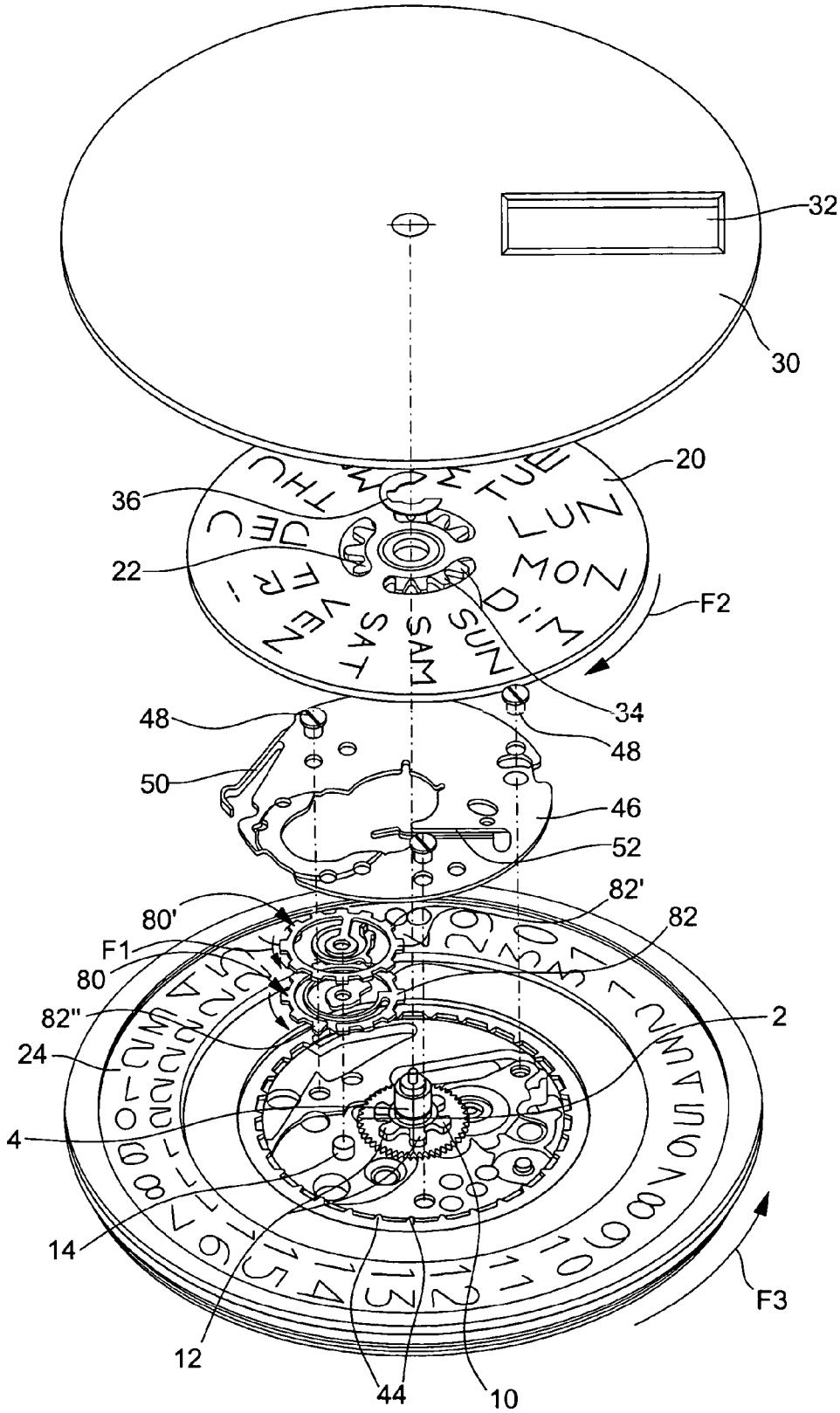
FIG. 6 is also an exploded perspective view of a second possible embodiment of the mechanism according to the invention.

By comparing FIGS. 5 and 6 to the known variant illustrated by FIGS. 3 and 4 of the calendar mechanism that is also known, shown in FIG. 1, it will be observed that apart from drive wheel 16, FIGS. 5 and 6 show not only all of the parts of the mechanism according to this variant, but also partially show those watch movement elements that are related to said mechanism.

It is thus unnecessary to describe again all of the common parts which are designated in FIGS. 5 and 6 by the same references as in the preceding Figures.

This having been said, the embodiment of the mechanism according to the invention shown in FIG. 5 differs from the variant in question in that the single drive wheel 16 of that variant is replaced by two superposed coaxial wheels 76 and 76', having the same diameter and the same number of teeth, respectively 78 and 78', in this particular case twelve teeth, which are both mounted on the same arbour 14 secured to the frame of the movement and driven by the same pinion 10 with six teeth secured to pipe 4 of hour wheel 2 of this movement.

Naturally, although they are designated by the same reference numerals and that there is no longer only one calendar drive wheel but two superposed wheels, the height of arbour 24 and the thickness of pinion 10 can be greater than that which they had in the known embodiment and variant previously described. For the same reason, the exact shape of plate 46, which allows these two wheels to be held in place, could be slightly altered, at least locally.

Moreover, as it is shown in FIG. 5, wheel 76 which is responsible for driving date crown 24 includes, like wheel 16 of FIGS. 1 to 4, a hub, a spoke and a tooth crown that are unreferenced. However, it no longer includes an elastic arm nor fingers for driving star-wheel 22 and day disc 20, which means that it could be made in another form provided that it continues to have, on the one hand, a longer tooth 78' than the others and of the same shape as previously so as to be able to drive the date crown and, on the other hand, sufficient natural elasticity to allow manual alteration of the date display in the same way as with the single drive wheel 16.

Figure 2:
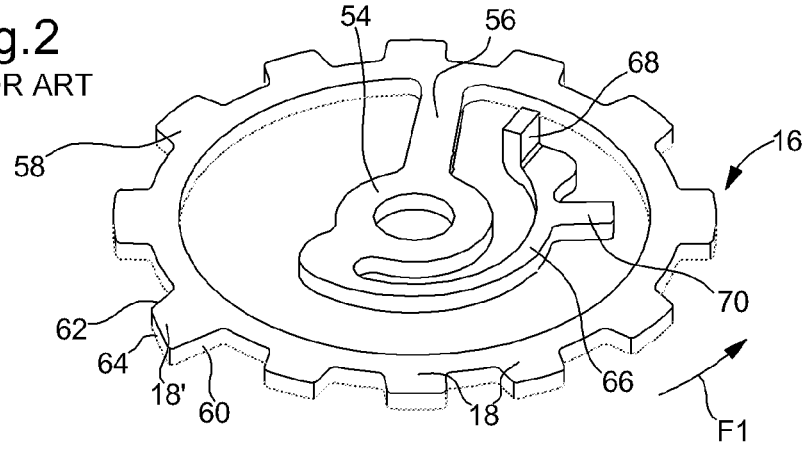
Fig.2 PRIOR ART

As regards wheel 76', which is located above the date drive wheel and whose role is to drive star-wheel 22 and day of the week disc 20, it is identical to wheel 16 of FIG. 2, except that it does not include any particular teeth and its twelve teeth 78' are identical.

It is thus unnecessary to describe the operation of the calendar mechanism according to the invention shown in FIG. 5. However, it is useful to show that this mechanism or a similar mechanism enable the aforementioned desired objects of the invention to be attained.

In fact, in such a mechanism, parameters for each of wheels 76 and 76', like the material of which they are formed, the shape of their teeth or their resistance to wear, can be determined separately as a function of the structural features and manufacturing methods of the wheel sets which they drive in order to optimise the operation of the calendar mechanism of which they form part.

Moreover, the mechanical stress experienced by wheels 76 and 76' which are also very thin and fragile but which only drive one wheel set each and in a single direction is much less than that experienced by a single wheel which drives two wheel sets rotating in opposite directions.

Furthermore and unlike the known mechanisms of FIGS. 1 to 4, the driving of the star-wheel and day disc can no longer have any negative influence on the elastic behaviour of the toothed drive crown of date crown 24 and vice versa.

Finally, in the case of the embodiment of the mechanism according to the invention of FIG. 5, it is easy to mount wheels 76 and 76' on arbour 14 such that star-wheel 22 and day disc 20 start to be driven before date crown 24 or vice versa. However, given that pinion 10 secured to hour wheel 2 only includes six teeth and drive wheels 76 and 76' twelve teeth, it is not possible to increase or decrease the time interval between the instants when said star-wheel and said day disc, on the one hand, and said date crown on the other hand, start to be driven, this interval necessarily remaining the same as for the known mechanism of FIGS. 1 to 4. However, in the case of the mechanism according to the invention, there exists a simple solution for solving this problem. This solution consists in multiplying to a certain extent the number of teeth of pinion 10 and wheels 76 and 76', while keeping a ratio of 2:1 between said wheels and said pinion. As regards the known mechanisms of FIGS. 1 to 4, it would also be possible to increase the number of teeth of pinion 10 and wheel 16, which is actually the case in the real movements already manufactured and marketed by the Applicant, but with a single drive wheel for the calendar mechanism this would not solve the problem.

As in the embodiment of FIG. 5, in the embodiment shown in FIG. 6, the mechanism according to the invention includes two superposed coaxial wheels 80, 80' having the same diameter and the same number of teeth, respectively 82 and 82', also twelve in number, mounted on the same arbour 14 secured to the movement frame and driven by the same pinion 10 with six teeth, secured to hour wheel 2 of the movement.

Figure 7:
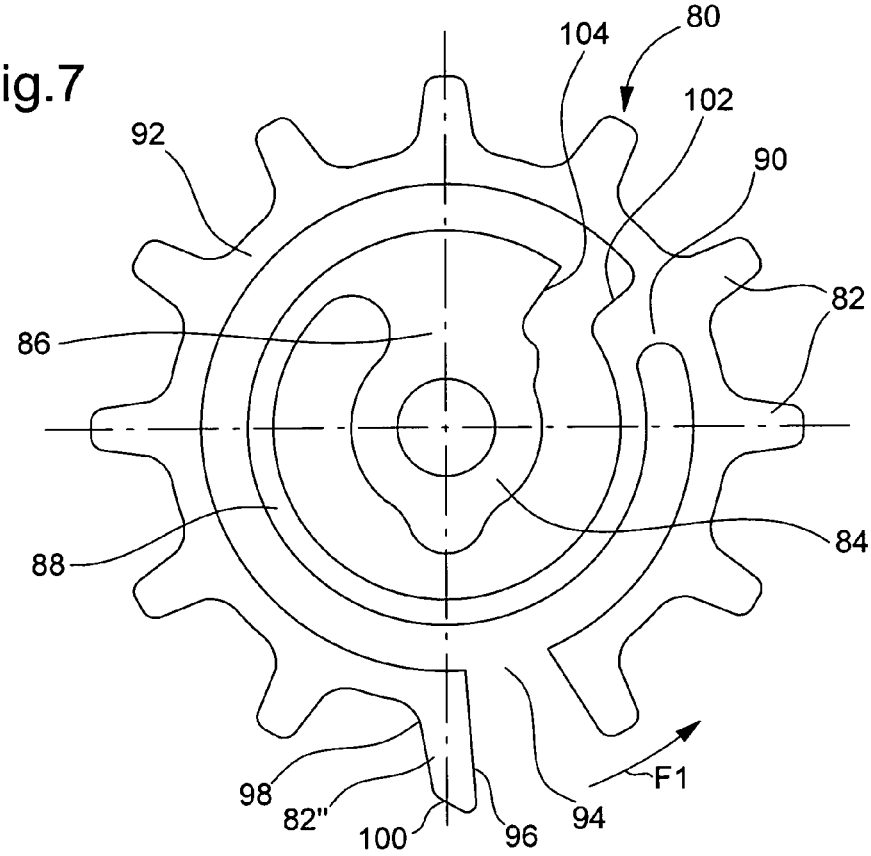
FIGS. 7 and 8 are plan and top views of two drive wheels of the mechanism of FIG. 6.

As FIG. 7 shows more clearly, wheel 80, provided for driving date crown 24, includes a hub 84 from which there extends a substantially radial wide arm 86. From the end of this radial arm 86 there extends an elastically deformable arm 88 substantially in the shape of an arc of a circle, which extends in the normal rotational direction of wheel 80, indicated by arrow F1, and which surrounds most of hub 84 to be attached via the inside and via a substantially radial and rigid connecting part 90 to a crown 92, which carries the teeth 82 of the wheel.

Like the toothed crown of drive wheel 76 of the embodiment of FIG. 5, crown 92 has a particular prominent tooth 82" that is longer than the others so as to be able to be engaged between teeth 44 of date crown 24 (see FIG. 6) and which has the same orientation and the same shape as the prominent teeth of the drive wheels and date crowns discussed hereinbefore.

However, in the embodiment of FIG. 6, this tooth 82" is no longer attached to normal tooth 82 which precedes it when wheel 80 is rotating in the direction of arrow F1, but is separated from the latter by a cut 94.

Thus, when the calendar mechanism is operating normally, and when front flank 96 of tooth 82" comes into contact with the back flank of a tooth 44 of date crown 24, said crown does not immediately start to be driven by tooth 82". Despite the motor torque exerted by pinion 10 on drive wheel 80 to rotate it in the direction of arrow F1 and because of a resistant inertial and friction torque exerted on the wheel in the opposite direction, tooth 82" starts by remaining still, which means that the spring formed by elastic arm 88 is wound until a substantially radial front flank 102 of connecting part 90 comes into contact with a corresponding back flank 104 of radial arm 86 joining hub 84 to elastic arm 88. During this time, the width of cut 94 of the wheel increases.

From the moment when the contact is established between front flank 102 of connecting part 90 and back flank 104 of arm 86, particular tooth 82" starts to drive date crown 24 in the same manner as tooth 78" of wheel 76 in the embodiment of FIG. 5, until said tooth 82" crosses tooth 44 of the date crown with which it was in contact and falls down into the next hollow of the date crown toothing, which enables elastic arm 88 to be let down.

Thus, in the case of the embodiment of FIG. 6 and as regards the driving of the date crown, the mechanism according to the invention is no longer of the dragging type, but is semi-dragging or, which amounts to the same thing, semi-instantaneous, which means that the change of date indication is quicker than in the embodiment of FIG. 5, the time of this change being able to be reduced roughly by half.

This having been said, when a quick alteration occurs to the date indication in response to a manipulation of a control stem and when a tooth 44 of date crown 24 comes into contact with the oblique face 100 of tooth 82", said date crown tooth 44 exerts a torque on tooth 82" which tends to rotate first drive wheel 80 in the direction of arrow F1. However, since pinion 10, which can then be considered immobile, opposes such a rotation, date crown tooth 44 slides over the oblique face 100, which only causes a slight tension in elastic arm 88 and a slight decrease in the width of cut 94 of crown 92 and as soon as tooth 44 passes the tip of tooth 82", drive wheel 80 returns to its original form.

Likewise, when pinion 10 rotates in the opposite direction to that of arrows F1 and F3 to enable a backward adjustment to the time setting of the timepiece, and when oblique face 100 of tooth 82" of wheel 86, which is then rotating in the opposite direction to that of the pinion, comes into contact with a date crown tooth 44, the torque exerted by tooth 82" on this tooth 44 is not enough to alter the position of the date crown and elastic arm 88 and cut 94 of crown 92 behave in the same way as previously.

Figure 8:
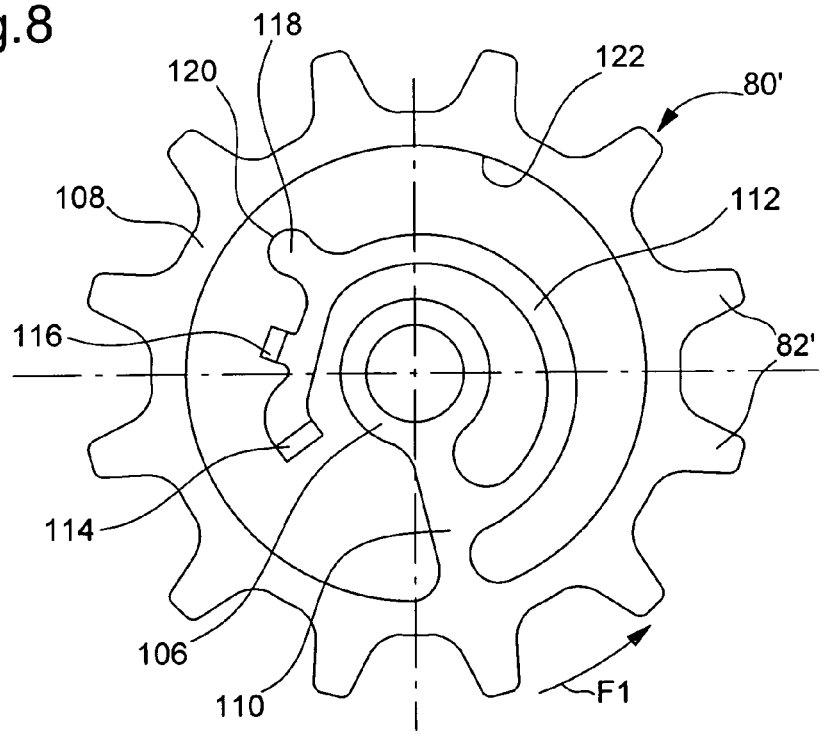

As FIG. 8 shows, wheel 80' for driving star-wheel 22 and day of the week disc 20 includes a hub 106, a crown 108 carrying teeth 82' and connected to hub 106 by a spoke 110, an elastic arm 112, substantially in the shape of an arc of a circle, which surrounds a part of hub 106 and which carries two drive fingers 114 and 116 formed and arranged in the same way as drive fingers 68 and 70' of drive wheel 16 shown in FIG. 4 and which forms part of the known calendar mechanism variant of FIG. 1.

Finally, elastic arm 112 of drive wheel 80' shown in FIG. 8 also carries a substantially radial support finger 118 located in the plane of said wheel which extends towards crown 108 and which ends in a rounded end part 120.

When wheel 80' is being driven normally in the direction of arrow F1 and when drive finger 114 comes into contact with the back flank of a tooth 34 of day star wheel 22 and starts to exert a torque on the tooth, elastic arm 112 tightens and moves away from hub 106 until end 120 of finger 118 abuts against the inner edge 122 of crown 108. During this time, first drive finger 114 pushes on the day star-wheel tooth sliding over the front flank of said tooth to its tip and from the moment when finger 118 comes into contact with inner edge 122 of the crown, the torque exerted by finger 114 on tooth 34 is practically at a maximum. Next, when finger 114 has passes the tip of tooth 34 of day star-wheel 22, it falls back into the hollow of star-wheel 22 following that between the teeth of which it was previously located and after the day star-wheel has rotated one fourteenth of a revolution, elastic arm 112 is let down.

The same thing occurs when second drive finger 116 rotates the day star-wheel again by one fourteenth of a revolution in the same direction and when wheel 80' is quickly driven again in the same direction to alter the indication of the day of the week by a manual command.

Moreover, it goes without saying that everything that was previously explained in relation to the direct alteration, or alteration via a time setting stem, remains valid with certain obvious adaptations, for the embodiment of FIGS. 6 to 8.

Finally, to conclude with the embodiment of FIGS. 6 to 8, it should be specified that finger 118 also acts as a limit stop for crown 92 of drive wheel 80 of date crown 24 arranged below drive wheel 80' of star-wheel 22, in order to prevent any possible blocking between these two wheels which are very thin and which can be deformed while they rotate.

This having been said, it is evident that the invention is not limited to the two embodiments that have just been described.

For example, the day disc in two languages could be replaced by a disc in a single language like that of FIG. 1. In such case, the drive wheel for the disc would only have a single drive tooth.

Moreover, the day disc could carry the days of the week only once and the day star-wheel could include only seven teeth.

On the other hand, the same disc and star-wheel could display the days in three languages.

As regards the drive pinion secured to the pipe of the hour wheel and the drive wheels of the date crown and the day disc, the number of their teeth could be less than or more than respectively six and twelve, the essential point being that the ratio of 2:1 is maintained between these numbers.

Of course, these are only examples since many other embodiments or variants can be imagined without departing from the scope of the invention.

The invention claimed is:

1. A calendar mechanism for displaying a date and a day of a week in a timepiece, comprising:

a date indicator formed by a crown with an inner toothing;

means for driving said date indicator including a first drive wheel having an external toothing so as to be able to be driven about an axis of rotation by a wheel set secured to an hour wheel of said timepiece, said external toothing comprising a prominent tooth and other teeth, said prominent tooth longer than said other teeth and disposed to abut against a tooth of the inner toothing of the date indicator to move it forward one day in a time interval located around a determined time of the day;

a day of the week indicator;

means for driving said day of the week indicator to move it forward one day during said time interval;

means for positioning said indicators wherein said means for driving the day of the week indicator comprises a second drive wheel fitted with an external toothing, superposed and coaxial to the first drive wheel, wherein said first and second drive wheels have respective diameters that are equal and respective even numbers of teeth which are equal, said first and second drive wheels both engaging said wheel set secured to said hour wheel so as to be driven by said wheel set, wherein said wheel set is formed by a pinion secured to a pipe of said hour wheel and including a number of teeth equal to half of that of said first and second drive wheels, wherein said day of the week indicator is a disc coaxial to said date indicator, wherein said means for driving said disc include a day star-wheel secured to said disc and driven by said second drive wheel, wherein said second drive wheel pivots on a fixed arbour and includes a hub via which it is mounted on said arbour and which is connected to a crown carrying said teeth and an elastic arm substantially in the shape of an arc of a circle, attached at least indirectly to said hub and partially surrounding said hub, and wherein said elastic arm has at its free end a first drive finger substantially perpendicular to the plane of said second wheel which is engaged between the teeth of said day star-wheel to move said day of the week indicator disc forward one day of the week when said calendar mechanism is operating normally.

2. The calendar mechanism according to claim 1, wherein the day of the week indicator disc carries alternately abbreviations of the days of the week in two different languages, wherein said day star-wheel includes fourteen teeth, wherein said elastic arm has a second drive finger also substantially perpendicular to the plane of said second drive wheel and wherein said second drive finger is located in relation to the first drive finger such that said drive fingers act one after the other on two successive teeth of said day star-wheel in order to rotate said day of the week disc twice by a fourteenth of a revolution in the same direction during said time interval located around a determined time of the day.

3. The calendar mechanism according to claim 1, wherein said elastic arm also carries a substantially radial support finger located in the plane of said second drive wheel and having one end which abuts against said crown of said second drive wheel when said elastic arm is deformed in the direction of said crown practically at the moment when said deformation is sufficient to allow said first drive finger to move said day of the week indicator disc forward one day, against said positioning means.

4. The calendar mechanism according to claim 1, wherein said elastic arm, said first drive finger, said teeth of the day of the week star-wheel and said means for positioning said star-wheel are designed such that said first drive finger slides over one of said teeth without any significant deformation of said elastic arm, in the direction of said hub and owing to a natural elastic deformation of said crown so that said day of the week indication is not altered when said pinion rotates in an opposite direction to that which allows it to drive said second drive wheel and said day star-wheel in their normal rotational directions.

5. A calendar mechanism for displaying a date and a day of a week in a timepiece, comprising:

a date indicator formed by a crown with an inner toothing;

means for driving said date indicator including a first drive wheel having an external toothing so as to be able to be driven about an axis of rotation by a wheel set secured to an hour wheel of said timepiece, said external toothing comprising a prominent tooth and other teeth, said prominent tooth longer than said other teeth and disposed to abut against a tooth of the inner toothing of the date indicator to move it forward one day in a time interval located around a determined time of the day;

a day of the week indicator;

means for driving said day of the week indicator to move it forward one day during said time interval;

means for positioning said indicators wherein said means for driving the day of the week indicator comprises a second drive wheel fitted with an external toothing, superposed and coaxial to the first drive wheel, wherein said first and second drive wheels have respective diameters that are equal and respective even numbers of teeth which are equal, said first and second drive wheels both engaging said wheel set secured to said hour wheel so as to be driven by said wheel set, wherein said wheel set is formed by a pinion secured to a pipe of said hour wheel and including a number of teeth equal to half of that of said first and second drive wheels, wherein said first drive wheel pivots on a fixed arbour and includes a hub from which extend a wide radial arm, an elastically deformable arm substantially in the shape of an arc of a circle, starting from a free end of said arm and extending in the normal rotational direction of said first drive wheel, said elastically deformable arm surrounding most of said hub to be attached via the interior and a substantially radial and rigid connecting part to a crown which carries said teeth; wherein said prominent tooth of the first drive wheel is separated from the tooth that precedes it when said wheel rotates in its normal rotational direction by a cut of said crown; and wherein, when said wheel rotates in the normal direction and when said prominent tooth comes into contact with a tooth of said date crown to drive the latter, said prominent tooth starts by remaining still while said elastically deformable arm tightens in the direction which brings it closer to said hub and that the width of said cut increases, until a front flank of said connecting part comes into contact with a back flank of said radial arm and said prominent tooth comes into contact with the tooth which precedes it, after which said prominent tooth drives said date crown to move it forward one day and then allow said drive wheel to return to its original form.

6. The calendar mechanism according to claim 5, wherein said prominent tooth of the first drive wheel has a substantially radial front flank like the other teeth to move the date indication forward one day when the mechanism is operating normally and a back flank which, at the end of said prominent tooth provided for engaging between the teeth of said date crown, has an oblique face of smaller inclination to form an acute angle with said front flank and wherein when said first drive wheel is driven in the opposite direction to its normal rotational direction and when said oblique face of the prominent tooth comes into contact with a tooth of the date crown, this tooth slides over said oblique face which causes a slight tension in the elastic arm and a slight decrease in the width of said cut of the crown of said first drive wheel but without altering the date indication.

* * * * *